US010290193B1

(12) United States Patent
Hsu

(10) Patent No.: US 10,290,193 B1
(45) Date of Patent: May 14, 2019

(54) AUTOMATICALLY MONITORING ALARM SYSTEM

(71) Applicant: Dong Guan Bright Yinhuey Lighting Co., ltd., Guang Dong (CN)

(72) Inventor: Kevin Hsu, Taichung (TW)

(73) Assignee: Dong Guan Bright Yinhuey Lighting Co., Ltd., Guang Dong (CN)

( * ) Notice: Subject to any disclaimer, the term of this patent is extended or adjusted under 35 U.S.C. 154(b) by 14 days.

(21) Appl. No.: 15/950,282

(22) Filed: Apr. 11, 2018

(51) Int. Cl.
*G08B 13/00* (2006.01)
*G08B 13/196* (2006.01)

(52) U.S. Cl.
CPC . *G08B 13/19645* (2013.01); *G08B 13/19632* (2013.01)

(58) Field of Classification Search
CPC ..... G08B 13/19645; G08B 13/19632
USPC ..... 340/541
See application file for complete search history.

(56) References Cited

U.S. PATENT DOCUMENTS 6,806,811 B1 * 10/2004 Readler ..... G08B 13/183 250/221
7,972,036 B1 * 7/2011 Schach ..... F21S 8/083 362/249.06
2009/0284595 A1 * 11/2009 Carter ..... G08B 13/19619 348/143
2010/0148961 A1 * 6/2010 Raphaeli ..... G01S 5/0289 340/552
2011/0062888 A1 * 3/2011 Bondy ..... H05B 33/0815 315/294
2011/0310621 A1 * 12/2011 Van Der Stok .... H05B 37/0254 362/311.12
2012/0026726 A1 * 2/2012 Recker ..... F21S 9/037 362/157
2014/0361874 A1 * 12/2014 Mandalapu ..... G08B 25/016 340/8.1
2015/0338077 A1 * 11/2015 Johnson ..... F21V 23/005 362/234
2016/0042621 A1 * 2/2016 Hogg ..... G06K 9/00771 348/155
2016/0161097 A1 * 6/2016 Xu ..... F21V 21/0824 362/382
2018/0167585 A1 * 6/2018 Ang ..... H04N 7/181
2018/0231199 A1 * 8/2018 Chien ..... F21V 21/08

* cited by examiner

*Primary Examiner* — Naomi J Small
(74) *Attorney, Agent, or Firm* — Alan D. Kamrath; Kamrath IP Lawfirm, P.A.

(57) ABSTRACT

A system includes a plurality of multifunctional ground insert lamps, a plurality of camera devices and a system controller. The multifunctional ground insert lamps and the camera devices are respectively connected with the system controller. The system controller controls operation of the camera devices according to the monitoring information of the multifunctional ground insert lamps. Each of the multifunctional ground insert lamps includes a monitoring module which includes a transmitter, a receiver and a lamp body. The receiver of each of the multifunctional ground insert lamps is connected with the transmitter of other multifunctional ground insert lamps. Two of the multifunctional ground insert lamps form a couple and have signals connected mutually. Thus, the multifunctional ground insert lamps construct a surveillance system and an illuminating system at the specified zone to provide monitoring, alarming and lighting functions simultaneously.

2 Claims, 3 Drawing Sheets

AUTOMATICALLY MONITORING ALARM SYSTEM

BACKGROUND OF THE INVENTION

1. Field of the Invention

The present invention relates to a surveillance device and, more particularly, to an automatically monitoring alarm system.

2. Description of the Related Art

A conventional ground insert lamp is usually mounted on a specified place, such as a park, plaza, square or the like, to function as a landscape light, so as to enhance the aesthetic quality of the specified place. However, the conventional ground insert lamp only provides an illuminating function and cannot provide a safety surveillance function, thereby limiting the versatility of the conventional ground insert lamp. Thus, the user has to mount a monitoring system additionally to provide the safety surveillance function, thereby affecting the aesthetic quality of the specified place, and thereby increasing the cost. In addition, the wiring work of the monitoring system is complicated, thereby causing inconvenience to the user.

BRIEF SUMMARY OF THE INVENTION

The primary objective of the present invention is to provide an alarm system with an automatically monitoring function. The alarm system is used to monitor a specified zone, so as to get a safety information in the specified zone.

In accordance with the present invention, there is provided an alarm system comprising a plurality of multifunctional ground insert lamps, a plurality of camera devices and a system controller. The multifunctional ground insert lamps are connected with the system controller. The camera devices are connected with the system controller. The multifunctional ground insert lamps provide a monitoring information to the system controller which controls operation of the camera devices according to the monitoring information of the multifunctional ground insert lamps. Each of the multifunctional ground insert lamps includes a monitoring module. The monitoring module includes a transmitter, a receiver and a lamp body. The receiver of each of the multifunctional ground insert lamps is connected with the transmitter of other multifunctional ground insert lamps. Two of the multifunctional ground insert lamps form a couple and have signals connected mutually. The multifunctional ground insert lamps construct a signal transmission network. When the brightness of the ambient environment reaches a preset value in the daytime, the lamp body is inoperative. The lamp body is operated at the night and has a working power that is 30% of a rated power. The monitoring module of each of the multifunctional ground insert lamps is initially disposed at a protected state. When a foreign object crosses or obstructs the signal transmission network, a signal transmission between the transmitter and the receiver is interrupted, so that the lamp body on the receiver that does not receive the signals is started and emits light or sound. The multifunctional ground insert lamps feed back the monitoring information to the system controller, and the system controller sends a command to the camera devices, so that the camera devices work and send an alarm signal to an APP of a mobile phone, and the monitoring module is disposed at an activated state. When the monitoring module is disposed at the activated state, the lamp body is operated with a working power that is 100% of the rated power.

Preferably, each of the multifunctional ground insert lamps further includes a stake, a pedal mounted on the stake, and a connecting pole mounted on the pedal. The monitoring module is mounted on the connecting pole.

Preferably, the alarm system further comprises an alarm device connected with the system controller. The system controller turns on/off the alarm device.

According to the primary advantage of the present invention, the multifunctional ground insert lamps construct a surveillance system and an illuminating system at the specified zone so as to provide monitoring, alarming and lighting functions simultaneously.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
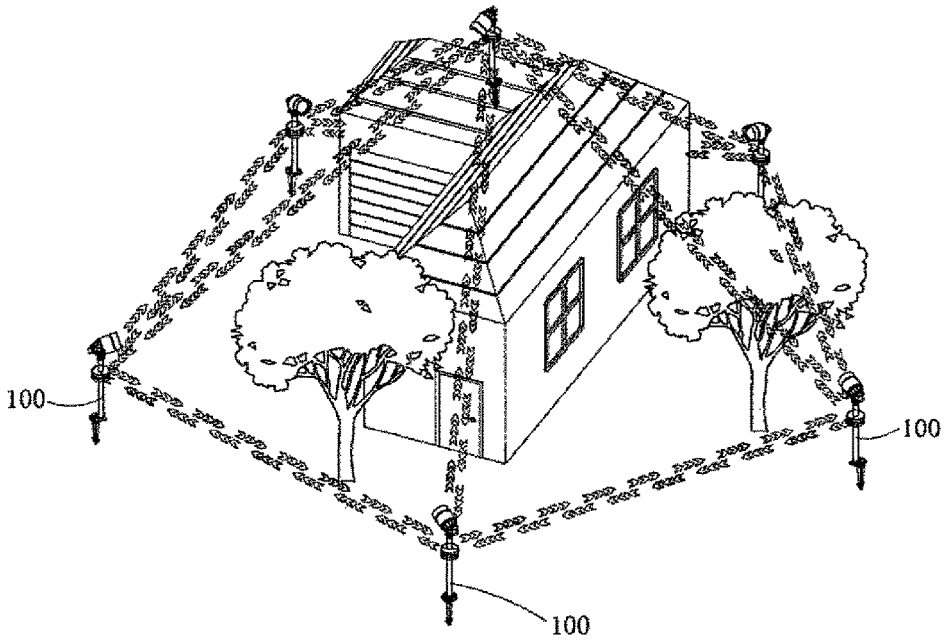
FIG. 1 is a schematic perspective view showing connection of multiple multifunctional ground insert lamps of an alarm system in accordance with the preferred embodiment of the present invention.
Figure 2:
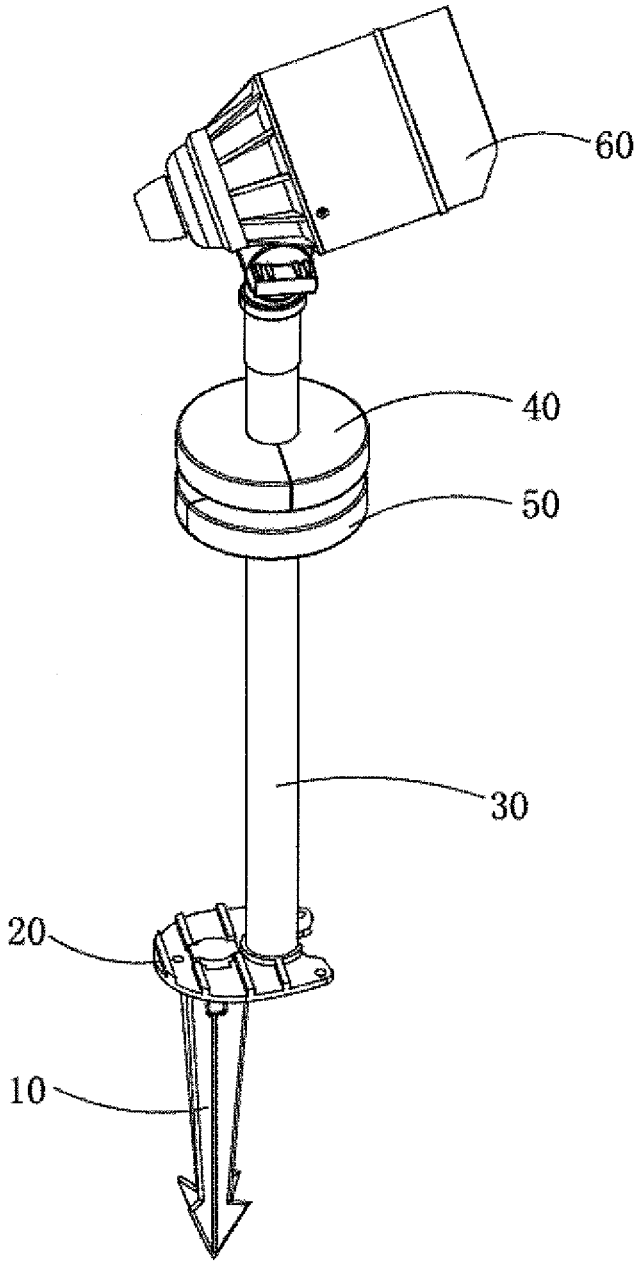
FIG. 2 is a perspective view of a multifunctional ground insert lamp of the alarm system in accordance with the preferred embodiment of the present invention.
Figure 3:
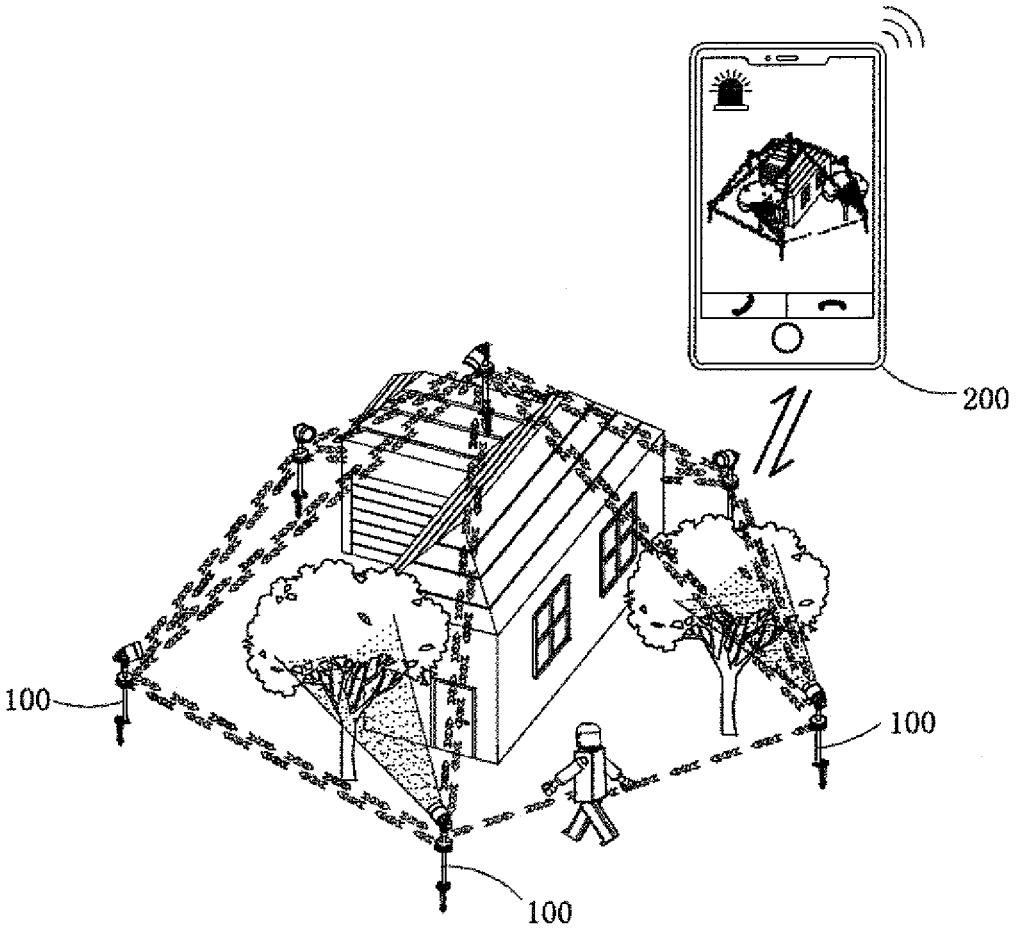
FIG. 3 is a schematic operational view of the alarm system as shown in FIG. 1 in use.

Referring to the drawings and initially to FIGS. 1-3, an automatic surveillance alarm system in accordance with the preferred embodiment of the present invention comprises a plurality of multifunctional ground insert lamps 100, a plurality of camera devices and a system controller. The multifunctional ground insert lamps 100 are connected with the system controller. The camera devices are connected with the system controller. The multifunctional ground insert lamps 100 enclose a specified zone (such as a house or the like) and provide a monitoring information of the specified zone to the system controller which controls operation of the camera devices according to the monitoring information of the multifunctional ground insert lamps 100. Each of the multifunctional ground insert lamps 100 includes a monitoring module (not labeled). The monitoring module includes a transmitter 40, a receiver 50 and a lamp body 60. The receiver 50 of each of the multifunctional ground insert lamps 100 is connected with the transmitter 40 of other multifunctional ground insert lamps 100. Two of the multifunctional ground insert lamps 100 form a couple and have signals connected mutually. The transmitter 40 transmits signals to the receivers 50 of other multifunctional ground insert lamps 100, and the receiver 50 receives the signals transmitted by the transmitters 40 of other multifunctional ground insert lamps 100. When an obstruction is located between the multifunctional ground insert lamps 100 of the same couple, the signal transmission between the multifunctional ground insert lamps 100 are interrupted.

In the preferred embodiment of the present invention, each of the multifunctional ground insert lamps 100 further includes a stake 10, a pedal 20 mounted on the stake 10, and a connecting pole 30 mounted on the pedal 20. The monitoring module is mounted on the connecting pole 30, with the connecting pole 30 being located between the pedal 20 and the receiver 50.

In the preferred embodiment of the present invention, the automatic surveillance alarm system further comprises an alarm device (not shown) connected with the system controller. The system controller turns on/off the alarm device.

In operation, referring to FIG. 3 with reference to FIGS. 1 and 2, the multifunctional ground insert lamps 100 construct a signal transmission network. When the brightness of the ambient environment reaches a preset value in the daytime, the lamp body 60 is inoperative. The lamp body 60 is operated at the night and has a working power that is 30% of a rated power. The monitoring module of each of the multifunctional ground insert lamps 100 is initially disposed at a protected state. When a foreign object crosses or obstructs the signal transmission network, a signal transmission between the transmitter 40 and the receiver 50 is interrupted, so that the lamp body 60 on the receiver 50 that does not receive the signals is started and emits light or sound. The multifunctional ground insert lamps 100 feed back the monitoring information to the system controller, and the system controller sends a command to the camera devices, so that the camera devices work and send an alarm signal to an APP of a mobile phone 200, and the monitoring module is disposed at an activated state. When the monitoring module is disposed at the activated state, the lamp body 60 is operated with a working power that is 100% of the rated power.

Accordingly, the multifunctional ground insert lamps 100 construct a surveillance system and an illuminating system at the specified zone so as to provide monitoring, alarming and lighting functions simultaneously.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An alarm system comprising:

a plurality of multifunctional ground insert lamps, a plurality of camera devices and a system controller;

wherein:

the multifunctional ground insert lamps are connected with the system controller;

the camera devices are connected with the system controller;

the multifunctional ground insert lamps provide a monitoring information to the system controller which controls operation of the camera devices according to the monitoring information of the multifunctional ground insert lamps;

each of the multifunctional ground insert lamps includes a monitoring module;

the monitoring module includes a transmitter, a receiver and a lamp body;

the receiver of each of the multifunctional ground insert lamps is connected with the transmitter of other multifunctional ground insert lamps;

two of the multifunctional ground insert lamps form a couple and have signals connected mutually;

the multifunctional ground insert lamps construct a signal transmission network which provides a surveillance function surrounding a house;

when the brightness of the ambient environment reaches a preset value in the daytime, the lamp body is inoperative;

the lamp body is operated at the night and has a working power that is 30% of a rated power;

the monitoring module of each of the multifunctional ground insert lamps is initially disposed at a protected state;

when a foreign object crosses or obstructs the signal transmission network, a signal transmission between the transmitter and the receiver is interrupted, so that the lamp body on the receiver that does not receive the signals is started and emits light or sound;

the multifunctional ground insert lamps feed back the monitoring information to the system controller, and the system controller sends a command to the camera devices, so that the camera devices work and send an alarm signal to an APP of a mobile phone, and the monitoring module is disposed at an activated state;

when the monitoring module is disposed at the activated state, the lamp body is operated with a working power that is 100% of the rated power;

the alarm system further comprises an alarm device connected with the system controller which turns on/off the alarm device; and the multifunctional ground insert lamps provide monitoring, transmission, alarming and lighting functions to the house simultaneously.

2. The alarm system of claim 1, wherein:

each of the multifunctional ground insert lamps further includes a stake, a pedal mounted on the stake, and a connecting pole mounted on the pedal; and the monitoring module is mounted on the connecting pole, with the transmitter and the receiver of each of the multifunctional ground insert lamps being located between the lamp body and the connecting pole.

* * * * *